United States Patent [19]

Allison

[11] 4,357,016

[45] Nov. 2, 1982

[54] MANIPULATION PUZZLE

[76] Inventor: Marvin H. Allison, 1336 Lexington Ave., Schenectady, N.Y. 12309

[21] Appl. No.: 186,176

[22] Filed: Sep. 11, 1980

[51] Int. Cl.[3] ..... A63F 9/08

[52] U.S. Cl. ..... 273/156; 70/290

[58] Field of Search ..... 273/153 R, 153 S, 155, 273/156, 160; 70/289, 290

[56] References Cited

U.S. PATENT DOCUMENTS

| | | | |
|---|---|---|---|
| 472,292 | 4/1892 | Goodson | 273/153 R |
| 3,216,558 | 11/1965 | Marsh | 273/153 S |
| 3,824,815 | 7/1974 | Darling | 273/156 |
| 4,065,132 | 12/1977 | Giakas | 273/153 R |

FOREIGN PATENT DOCUMENTS

| | | | |
|---|---|---|---|
| 758402 | 11/1933 | France | 273/155 |

*Primary Examiner*—Anton O. Oechsle
*Attorney, Agent, or Firm*—Paul I. Edelson

[57] ABSTRACT

A manipulation puzzle consisting of rigid or semi-rigid components is disclosed. The puzzle is solved by manipulating the components through a specific sequence of movements, in predetermined order, in accordance with a code employed in the construction of the puzzle. Various interacting components are interchangeable, thereby providing for the construction of "families" of puzzles. The puzzle comprises a plurality of ring members disposed to form a cylinder about a plurality of longitudinal slide members forming an interior cylinder on a common axis with the ring members. The solution is programmed into the elements by a series of pegs on one set of members, and a cooperative set of grooves on the other set of members.

17 Claims, 9 Drawing Figures

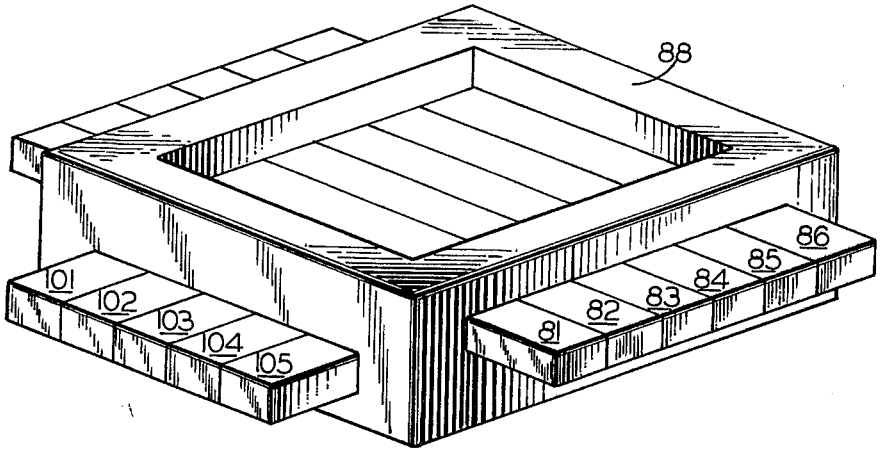
88
101
102
103
104
105
81
82
83
84
85
86
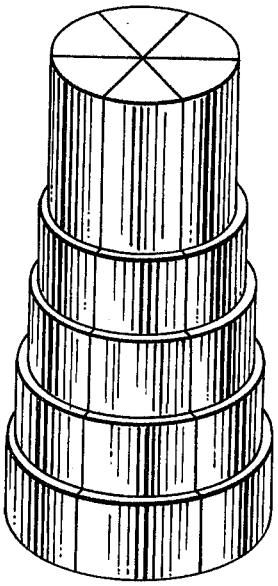

MANIPULATION PUZZLE

FIELD OF THE INVENTION

This invention relates to games and puzzles, more particularly to puzzles composed of interlocking geometric shapes.

BACKGROUND OF THE INVENTION

Prior art solid puzzles are characterized by having a single "correct" position for each component of the puzzle. This results in puzzles of relatively simple solution since the complexity can only be increased by increasing the number of components. In some such prior art puzzles, further, the correct manipulation of each component is properly performed only once. This further simplifies the solution of the puzzle to the point where such puzzles are considered trivial by true puzzle afficionados.

Puzzles intended to be assembled and disassembled have been known for many years. One type of such puzzle is illustrated by the wooden puzzles available in novelty stores which form spheres, cubes, barrels and other such shapes.

These puzzles are characterized by:

1. Rigid components
2. Complete separation of all components as part of the solution
3. The orderly addition of components to form the assembly
4. Completion of the puzzle when the last piece is added A second type of puzzle is illustrated by the Chinese Rings puzzle. This puzzle which is at least 400 years old consists of two subassemblies which are combined by manipulation in a predetermined sequence to form the final assembly.

Puzzles of this type are characterized by:

1. Two or more components at least one of which is non-rigid, either a cord or a multipart assembly which cannot be disassembled into its constituent parts.
2. Manipulation of the components relative to each other in a predetermined sequence of multiple steps.

SUMMARY OF THE INVENTION

To many persons, a puzzle composed entirely of solid, rigid or semi-rigid, components is esthetically more pleasing than the prior art puzzles of the "Chinese Rings" variety.

It is, accordingly, an object of this invention to provide a novel puzzle composed of a plurality of rigid, or semi-rigid, components in which each component must be manipulated, iteratively, in a predetermined sequence to obtain the solution.

It is another object of this invention to provide such a puzzle in which elements of the puzzle are interchangable with other puzzle elements to provide families of puzzles having differing solutions without the need to replace all elements.

It is another object of this invention to provide such a puzzle in which the component elements are adapted to be fabricated simply and inexpensively, by mass production techniques.

Yet another object of this invention is to provide such a puzzle composed of elements in a form pleasing to the visual and tactile senses.

Briefly, and in accordance with one embodiment of this invention, a puzzle comprises a plurality of longitudinal slide members, forming, when placed together in their operative configuration, a cylinder, and a plurality of ring members forming a similar cylinder surrounding the cylinder formed by the slide members. The puzzle program is established by a series of grooves in the outer surface of the cylinder formed by the assembled slide members and a series of projections upon the inner surface of the cylinder formed by the surrounding ring members. Alternatively, the grooves and projections can be reversed between the inner and outer cylinders. The solution of the puzzle consists of the rotation of the ring members and the translation of the slide members in a sequence predetermined by the groove and projection pattern. In another alternative embodiment, a plurality of slides interact with a single ring. Each element of the puzzle, both slide and ring, must be manipulated a plurality of times, in the correct order and sense to solve the puzzle. The solution is obtained by the complete disassembly of all components.

The novel features of this invention sought to be patented are set forth with particularity in the appended claims. The invention, together with further objects and advantages thereof, may be understood from a reading of the following specification and appended claims in view of the accompanying drawings in which:

FIG. 1 is an isometric view of an assembled puzzle in accordance with one embodiment of this invention in which a plurality of slide members form a solid cylinder which is surrounded by an annular sleeve comprising a plurality of ring members. FIG. 1 is dimensionally distorted in that the slide members have been elongated to more clearly show the groove patterning thereon to better illustrate the operation of the puzzle.

FIG. 3 is dimensionally accurate.

FIG. 8 is an isometric view of an embodiment of this invention designed for purely translational manipulation.

FIG. 9 is an isometric view of the cylindrical member in an embodiment in which said member has a stepped configuration.

Figure 1:
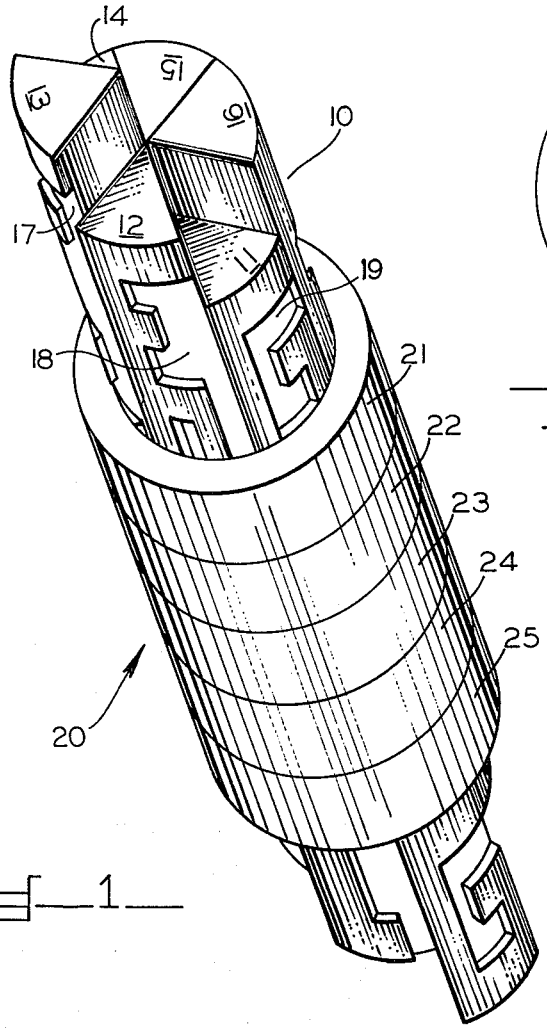

In the embodiment illustrated in FIG. 1, a manipulation puzzle comprises a cylindrical member indicated generally at 10, and surrounding annular member indicated generally at 20. Cylindrical member 10 comprises a plurality of solid prismatical slide members 11, 12, 13, 14, 15 and 16. Annular sleeve member 20 comprises a plurality of ring members 21, 22, 23, 24, and 25. The embodiment of FIG. 1 thus comprises six slide members forming the cylindrical member, and five ring members forming the annular member. The precise number of slide and ring members comprising the puzzle is a matter of choice, increasing puzzle complexity being obtainable through increased numbers of elements. The particular embodiment illustrated in FIG. 1 has been actually reduced to practice to construct a puzzle having 11 components and requiring 29 correct moves in the correct order for its solution. An advantage of the puzzle of this invention is thus immediately apparent, since the most complex of the prior art solid puzzles comprising 11 components are solvable in approximately 12 moves. In the embodiment actually reduced to practice, as illustrated in FIG. 1, slide members 11–16 are geometrically congruent shapes, with the exception of the groove patterns on the curved surfaces of each slide member. Puzzles in accordance with this invention may be constructed having non-congruent slide members, if desired, so long as the slide members form a complete cylinder when assembled. The illustrated embodiment, having congruent slide members, is preferred because it provides for interchangability of the slide members to permit the construction of families of puzzles having a plurality of solutions.

Each of the slide members 11–16 has a groove pattern cut into the curved surface thereof. As shown in FIG. 1, slide 11 has groove pattern 19, slide 12 has groove pattern 18, and slide 13 has groove pattern 17 on the curved surface. The remaining slide members also have groove patterns on them, but the patterns are not shown in FIG. 1. Each slide has a groove pattern thereon differing from the pattern on each other slide. In the preferred embodiment, each ring member, for example ring member 21 as shown in plan view in FIG. 2, has a plurality of projections 26 on the inner surface thereof. The number of projections on each ring member is equal to the number of slide members forming the cylindrical member. Each of projections 26 rides within the grooves on the curved surface of its associated slide member. The grooves 17, 18, 19 and 31, 32 and 33, as shown in FIG. 3 and projections cooperatively serve to limit the allowable movements of slide members 11–16 and ring members 21–25, and to physically define the puzzle program.

Figure 3:
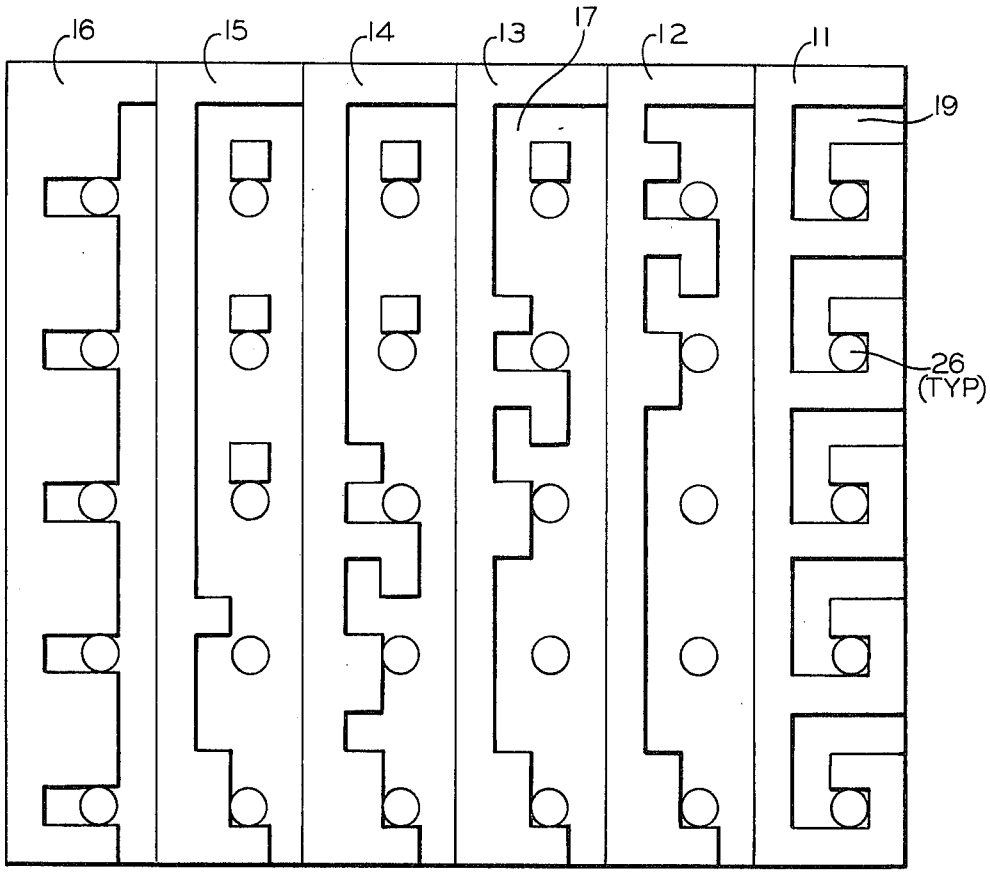
FIG. 3 is a developed schematic view of the functionally cooperative surfaces of the embodiment of FIG. 1 illustrating the operating principle of puzzles in accordance with this invention.

The puzzle program, and the inter-action of its components, may be best understood with reference to FIG. 3 which illustrates a developed plan view of the curved surfaces of cylindrical member 10 showing the groove pattern in each of slides 11–16 and projections 26 of ring members 21–25 in inter-active relation therewith. The inner diameter of the rings is such that the slides except for the interference between the projections and the walls of the grooves may move lengthwise easily relative to each other and to the rings yet are constrained to their assembled cylindrical form in the radial directions. At the same time the rings may rotate relative to each other and the overall cylindrical form of the slides except for the interference between the projections and the walls of the grooves. The aforementioned grooves are slightly larger than the diameter of the projections which in this embodiment of the invention are round. The same grooves are also slightly deeper in a radial direction than the distance which the projections extend radially from the inner surface of the rings.

The structure of this invention is such that the movement of the slides and the rings relative to each other is limited by the grooves and the position of the slides relative to each other. The pattern, the number of slides, and the number of rings determines both the sequence of manipulations and the difficulty of solution for a particular embodiment.

Figure 2:
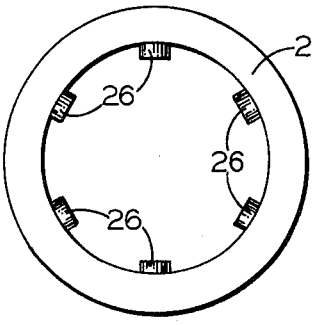
FIG. 2 is a top plan view of the ring members of the embodiment of FIG. 1.

In the embodiment illustrated in FIGS. 1–3, slides 11–16 and rings 21–25 may be formed of any convenient material. In the embodiment actually reduced to practice, these elements were formed of wood. The preferred materials are injection molded plastic, because of the minimal expense of fabricating puzzles in accordance with this invention in that manner, and wood because of the visually and tactually pleasing embodiments which can be produced using wood, although at somewhat greater cost. While not preferred, it should be understood that puzzles within the scope of the claimed invention may be constructed from any other suitable material including metals, ceramics, and the like.

Similarly, the overall shape of the puzzle illustrated in FIGS. 1–3 consisting of slides 11–16 having straight sides and forming cooperatively right circular cylindrical member 10 and ring members 21–25 forming cooperatively right circular annular sleeve 20 are preferred as combining an esthetically pleasing cylindrical overall shape, combined rotational manipulation of the ring members and translational manipulation of the slide members, and a geometry which lends itself to inexpensive manufacture. This invention, however, is not so limited by configuration, but includes all puzzles having elements interacting in the manner illustrated in FIG. 3 and more particularly described hereafter, and may, if desired, assume other configurations such as those illustrated in FIGS. 4–9 by way of example.

Figure 4:
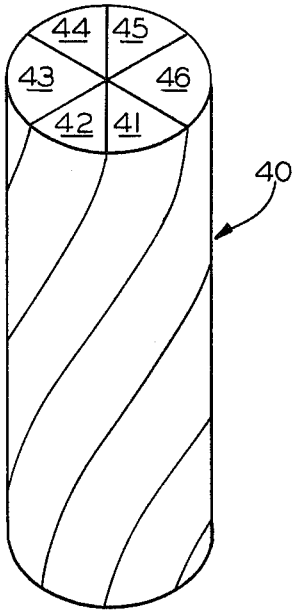
FIG. 4 is an isometric view of the cylindrical member in accordance with an embodiment of this invention having helical slide members.

FIG. 4 illustrates an alternative configuration of the components of inner cylindrical member 40 which corresponds to member 10 of FIG. 1. In this embodiment, slides 41–46 are helical segments. In a puzzle constructed as illustrated in FIG. 4, the manipulation of the slide members is a combined rotational and translational movement as opposed to the purely translational movement of the slides of FIG. 1.

Figure 5:
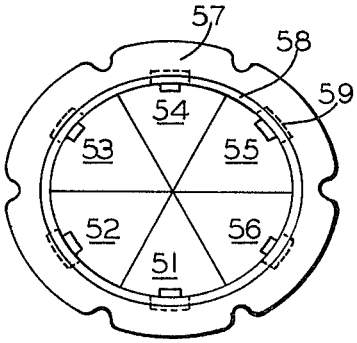
FIG. 5 is a top plan view of another embodiment of this invention having eliptical cylindrical and annular members.

FIG. 5 illustrates an alternative embodiment in which slides 51–56 combine to form an elliptical cylindrical member, and in which the ring members, one of which, 57, is illustrated, are formed of an elastic material such as a synthetic rubber material to allow for rotation of the rings about the elliptical path. In this embodiment, the projections of the inner-surfaces of the ring members are preferably formed of a rigid material embedded in the elastic material. In this embodiment the mutually facing surfaces of the cylindrical and annular members are preferably provided with a friction reducing material band or tape member 58 of a fluorocarbon or similar material as that sold under the trade name TEFLON therebetween. Additionally, if desired, the elastic rings may be provided with a plurality of blocks of rigid material, one of which is shown at 59 in FIG. 5, to back and stabilize the projections.

Figure 6:
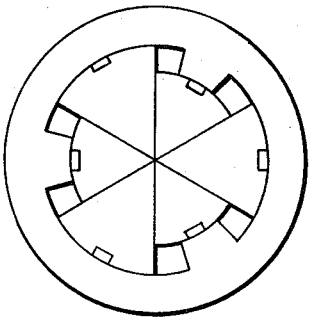
FIG. 6 is a top plan view of a puzzle in accordance with another embodiment of this invention wherein the cylindrical and annular members have varying radii.
Figure 7:
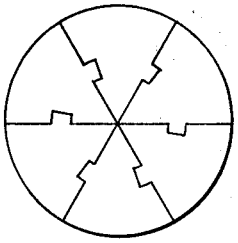
FIG. 7 is a top plan view of the cylindrical member in which its component slides are interlocked by tongues and grooves.

Puzzles in accordance with this invention may also, if desired, be constructed with elements having additional continuous interlocking grooves and projections as shown in FIGS. 6 and 7. These may be furnished for the esthetic effect of the pattern presented to the eye by the assembled components. The additional inter-locks being continuous, are not operative to change the manipulative program of the puzzle, which remains governed by the surface groove patterns as illustrated in FIG. 3. In FIG. 6, the additional inter-locking pattern is provided by providing slide members of differing radial dimension and ring members having additional, puzzle program inoperative, projections to mate with the cylindrical member composed of slide members of varying radii. In FIG. 7, each slide member interlocks with its adjacent slide members in continuous tongue and groove fashion.

FIG. 8 illustrates an embodiment of this invention in which no cylindrical elements are employed. A frame member 88 supports a first plurality of rectangular prismatical slide members 81–86 having a groove pattern, for example that of FIG. 3, on, for example, the lower surfaces thereof as illustrated in FIG. 8. Frame 88 also supports a plurality of slide members 101–105 in a plane parallel to that of slides 81–86. Slides 101–105 have projections on, for example the upper surfaces thereof to interact with the groove patterns of slides 81–86. The manipulation and solution of the puzzle constructed in accordance with FIG. 8 is identical with that of the puzzle of FIG. 1, with the exception that no rotational motion is involved, each set of slides being manipulated translationally in accordance with the puzzle program.

FIG. 9 illustrates another embodiment in which the slide members and ring members vary in radial dimension to form a puzzle having a differing overall assembled shape from that of FIG. 1, but being otherwise identical thereto.

Each of the embodiments of puzzle described hereinabove may be constructed to be solved by a series of manipulation steps identical to that for the solution of each other of the above-described embodiments, and are accordingly equivalent forms of the inventive puzzle disclosed and claimed herein. In each case, the puzzle program, and the manipulative steps leading to its solution, are based upon a binary Gray code. A Gray code is a sequence of numbers, each of which differs in only one digit from its predecessor and its successor.

Referring again to FIGS. 1 and 3, the theory of operation as applied to the illustated embodiment may now be easily understood. In this discussion, the device is treated as a finite state mechanism, that is a mechanism whose component parts can attain only a limited number of positional relationships with each other. Each such positional relationship or configuration is called a state. The solution path of the puzzle is the set of manupulations required to advance the puzzle from its initial state through the intermediate states to its final state (completely assembled). "Permitted" states are those states which the groove patterns of the particular implementation permit attaining. This analysis considers only those states in which two or more components can be manipulated. This does not reduced the validity of the analysis but allows the consideration of only those states which influence the solution path. In particular, when a component is being moved from one position to another, it can occupy many positions but these are of no interest since only one component at a time can be moved in these situations.

The three positions of a slide can be expressed as 1, 2, and 3 for its "Up", "Intermediate" and "Down" positions respectively. The three positions of a ring can be expressed as 1, 2, and 3 for its "A", "B" and "C" positions respectively. Any of the permitted states can be described completely by an eleven digit number called the "State Number" in which each digit represents the position of a specific component of the puzzle. Using the component numbers of FIGS. 1, 2 and 3, let the first, third, fifth, seventh, ninth and eleventh digits represent the position of slides 11, 12, 13, 14, 15 and 16 respectively. Similarly, let the second, fourth, sixth, eight and tenth digits represent the positions of rings 21, 22, 23, 24 and 25 respectively.

We define one further "permitted" state as state 0. This state represents the completely disassembled state of the puzzle regardless of the relative positions of the components of the puzzle.

The state number of the assembled puzzle is expressed as 1212121212121 All slides are in position 1 ("Up") and all rings are in position 2 ("B").

In the preferred implementation, slide 12 and ring 22, slide 13 and ring 23, slide 14 and ring 24 share a particular relationship, i.e. for each pair, states 32 and 11 are not permitted. Further, for all states of the puzzle except for those in which slide 11 is in the "Down" position the only "path" for these three pairs of components from a pair state of 31 to a pair state of 12 is the path 31-21-22-12. Slide 12 for example must move from position 3 ("Down") to position 2 ("Intermediate") before ring 22 can be moved from position 1 ("A") to position 2 ("B"). Slide 12 cannot advance from position 2 to position 1 until ring 22 has moved to position 2. Similarly the path 12-22-21-31 is the only "path" from the pair state 12 to the pair state 31. In view of this restrictive relationship, in the example solution path the only states listed are those that have pair states 12 or 31 for the above pairs.

The sequence of manipulations for assembling the particular embodiment of the puzzle illustrated in FIGS. 1, 2, 3 is given herewith as a demonstration of the complexity of solution path possible with this invention.

Referring to FIG. 3, slide 11 is in the "Down" position while slides 12, 13, 14, 15, and 16 are in the "Up" position. Rings 21, 22, 23, 24, and 25 are shown in the "B" position. This is the initial assembled position.

In the column headed "MOVE", S15D means "Move slide 15 to the 'Down' position." Similarly, S15U means "Move slide 15 to the 'Up' position." R22B means "move ring 22 to the 'B' position." Several manipulations are shown for some of the moves in order to portray the solution in a more logical manner and to eliminate listing states which are not important in the analysis.

| MOVE | RESULTING STATE NUMBER |
|---|---|
| Initial position | 32121212121 |
| 1. S15D | 32121212321 |
| 2. R24B S14I R24A S14DD | 32121231321 |
| 3. R23B S13I R23A S13D | 32123131321 |
| 4. R22B S12I R22A S12D | 32313131321 |
| 5. R25A | 32313131311 |
| 6. R21A | 31313131311 |
| 7. S11U | 11313131311 |
| 8. R25B | 11313131321 |
| 9. R21B | 12313131321 |
| 10. S12I R22B S12U | 12123131321 |
| 11. R21A | 11123131321 |
| 12. S13I R23B S13U | 11121231321 |
| 13. R21B | 12121231321 |
| 14. S14I R22A S12D | 12311231321 |
| 15. R21A | 11311231321 |
| 16. S14I R24B S14U | 11311212321 |
| 17. R21B | 12311212321 |
| 18. S12I R22B S12U | 12121212321 |
| 19. R21A | 11121212321 |
| 20. S13I R23A S13D | 11123112321 |
| 21. R21B | 12123112321 |

-continued

| MOVE | RESULTING STATE NUMBER |
|---|---|
| 22. S12I R22A S12D | 12313112321 |
| 23. R21A | 11313112321 |
| 24. S15U | 11313112121 |
| 25. R21B | 12313112121 |
| 26. S12I R22B S12U | 12123112121 |
| 27. R21A | 11123112121 |
| 28. S13I R23B S13U | 11121212121 |
| 29. R21B | 12121212121 |

The invention claimed is:

1. A puzzle having an assembled configuration and a disassembled configuration comprising:

a first plurality of members in which each member is movable relative to each other member and in which each member has face having a pattern thereon;

at least one other member having a face having a pattern thereon;

said patterns comprising variations in the dimension of said members and other members perpendicular to said faces;

said first plurality of members being configured to form a first surface comprising the faces of each member, said first surface having a variable pattern thereon which is varied by relative movement of said members of said first plurality;

said at least one other member being configured to form a second surface comprising the faces of each said other member;

said first surface and said second surface being in closely spaced mutually facing relation and said first plurality of members being maintained in assembled relationship with each other and with said at least one other member solely by the interaction of said surfaces, said variable pattern interacting with said pattern on said face of said at least one other member to define a solution path for said puzzle, said solution path comprising an ordered sequence of movement of said first plurality of members and said at least one other member.

2. A puzzle as claimed in claim 1 wherein said at least one other member comprises a second plurality of members in which each member is movable relative to each other member and in which each member has a face having a pattern thereon.

3. A puzzle as claimed in claim 1 wherein:

said first plurality of members comprises a plurality of cylinder segments;

each said segment having at least two surfaces configured to slidably adjoin other segments and at least one curved surface;

said face having a pattern being said curved surface;

said segments forming a complete cylinder when each segment is slidably adjoined to another segment; and said at least one other member is an annular member.

4. The puzzle of claim 3 wherein:

said plurality of cylinder segments collectively form a cylindrical body when said puzzle is assembled; and said at least one other member is a plurality of annular members collectively forming an annular body similar to said cylindrical body when said puzzle is assembled.

5. The puzzle of claim 4 wherein said cylinder segments and said annular members are wooden members.

6. The puzzle of claim 4 wherein said cylinder segments and said annular members are plastic members.

7. The puzzle of claim 4 wherein said cylindrical body is a circular cylindrical body.

8. The puzzle of claim 3 wherein said two surfaces configured to slidably adjoin of each said segment each have a pattern thereon for mutually interlocking with another segment.

9. The puzzle of claim 3 wherein said plurality of cylinder segments comprise a first set of segments having a first radial dimension along said surfaces configured to slidably adjoin and a second set of segments having a second radial dimension along said surfaces configured to slidably adjoin, and wherein said annular member varies in radial dimension to maintain said closely spaced mutually facing relation.

10. The puzzle of claim 3 wherein said cylinder segments are helical in shape.

11. The puzzle of claim 3 wherein said cylinder segments form an elliptical cylindrical body when said puzzle is assembled.

12. The puzzle of claim 11 wherein said cylinder segments are wooden members and said annular member is an elastic member.

13. The puzzle of claim 12 including additionally a low friction tape member attached to said annular member upon said face having a pattern thereon.

14. The puzzle of claim 13 including additionally a rigid member embedded in said elastic member at a location directly underlying said pattern.

15. A puzzle as claimed in claim 1 wherein said ordered sequence of movement of said members comprises an iterative sequence of manipulations of said members.

16. The puzzle of claim 15 wherein said iterative sequence is a Gray Code.

17. The puzzle of claim 16 wherein the members of said first plurality are substantially congruent so as to be positionally interchangeable with each other and wherein said solution path varies as said members of said first plurality are positionally interchanged.

* * * * *